US007766702B2

(12) United States Patent
De France et al.

(10) Patent No.: US 7,766,702 B2
(45) Date of Patent: Aug. 3, 2010

(54) CONDUCTOR CONNECTION

(75) Inventors: Robert V. De France, Poughkeepsie, NY (US); Daniel D. Dobrinski, Hillsborough, NH (US); Bernard C. Crutcher, Londonderry, NH (US)

(73) Assignee: Burndy Technology LLC, Manchester, NH (US)

( * ) Notice: Subject to any disclaimer, the term of this patent is extended or adjusted under 35 U.S.C. 154(b) by 0 days.

(21) Appl. No.: 11/778,755

(22) Filed: Jul. 17, 2007

(65) Prior Publication Data

US 2008/0026644 A1 Jan. 31, 2008

Related U.S. Application Data

(63) Continuation-in-part of application No. 11/586,970, filed on Oct. 25, 2006, now Pat. No. 7,534,976.

(60) Provisional application No. 60/833,642, filed on Jul. 26, 2006, provisional application No. 60/904,080, filed on Feb. 28, 2007.

(51) Int. Cl.
*H01R 4/50* (2006.01)

(52) U.S. Cl. ..... 439/783; 439/772; 439/863

(58) Field of Classification Search ..... 439/783, 439/772, 774, 807, 863
See application file for complete search history.

(56) References Cited

U.S. PATENT DOCUMENTS

| | | | | |
|---|---|---|---|---|
| 1,172,604 A | | 2/1916 | Johnson, Jr. | |
| 1,964,511 A | | 6/1934 | Grover | 173/273 |
| 2,096,796 A | | 10/1937 | Dunaway | 173/273 |
| 2,811,703 A | | 10/1957 | Becker | 339/264 |
| 2,986,721 A | | 5/1961 | Conright | 339/109 |
| 3,065,449 A | * | 11/1962 | Matthysse et al. | 439/783 |
| 3,462,543 A | | 8/1969 | Wahl et al. | 24/126 |
| 3,588,791 A | | 6/1971 | Polidori | 339/247 |
| 3,614,700 A | | 10/1971 | Beard et al. | 337/203 |
| 3,621,160 A | | 11/1971 | Turner et al. | 200/48 |
| 3,670,372 A | | 6/1972 | Crosby et al. | 24/125 N |
| 3,836,102 A | | 9/1974 | Hall | 248/74 R |
| 4,330,906 A | | 5/1982 | Werner | 24/136 R |
| 4,415,222 A | * | 11/1983 | Polidori | 439/807 |
| 4,504,034 A | | 3/1985 | Werner | 248/63 |
| 4,600,264 A | | 7/1986 | Counsel | 339/247 |
| 4,734,062 A | * | 3/1988 | Goto | 439/783 |

(Continued)

OTHER PUBLICATIONS

Tyco Electronics Instruction Sheet, AMPACT* In-Line Disconnect Assemblies, 408-4097, Sep. 26, 2005, Rev. C., 4 pgs.

(Continued)

*Primary Examiner*—Tho D Ta
*Assistant Examiner*—Travis Chambers
(74) *Attorney, Agent, or Firm*—Harrington & Smith

(57) ABSTRACT

Disclosed herein is an electrical connector frame member. The electrical connector frame member includes a first leg section, a conductor receiving section, and a wedge section. The first leg section is configured to be connected to an electrical isolator. The conductor receiving section is connected to the first leg section. The conductor receiving section is configured to receive an electrical conductor. The wedge section extends from the conductor receiving section. The wedge section is integrally formed with the conductor receiving section and comprises a wedge connector shell contact surface. The wedge connector shell contact surface is angled relative to the conductor receiving section.

28 Claims, 9 Drawing Sheets

U.S. PATENT DOCUMENTS

| | | | | |
|---|---|---|---|---|
| 4,857,020 | A | 8/1989 | Crosby | 439/783 |
| RE33,098 | E | 10/1989 | Center | 60/635 |
| 5,006,081 | A | 4/1991 | Counsel et al. | 439/783 |
| 5,029,797 | A | 7/1991 | Levorchick et al. | 248/459 |
| 5,092,797 | A * | 3/1992 | Cole et al. | 439/783 |
| 5,240,441 | A | 8/1993 | Laricchia et al. | 439/783 |
| 5,340,335 | A | 8/1994 | Haun | 439/783 |
| 5,397,982 | A | 3/1995 | Van Lankvelt | 324/126 |
| 5,423,699 | A * | 6/1995 | Johnson | 439/783 |
| 5,507,671 | A | 4/1996 | Chadbourne et al. | 439/783 |
| 5,581,051 | A * | 12/1996 | Hill | 174/138 R |
| 6,448,503 | B1 | 9/2002 | McKinnon et al. | 174/146 |
| 6,713,679 | B2 | 3/2004 | Roberts | 174/135 |

OTHER PUBLICATIONS

Tyco Electronics Canada Ltd., Drawing C-83881, Rev. E., Jul. 25, 2001, In-Line Switch Assembly, 29 kV, Ampact, 1 sheet.

* cited by examiner

CONDUCTOR CONNECTION

CROSS REFERENCE TO RELATED APPLICATIONS

This application is a continuation-in-part of U.S. application Ser. No. 11/586,970 filed Oct. 25, 2006 now U.S. Pat. No. 7,534,976. This application also claims priority under 35 U.S.C. §119(e) to U.S. provisional patent application No. 60/833,642 filed Jul. 26, 2006, and U.S. provisional patent application No. 60/904,080 filed Feb. 28, 2007, which are hereby incorporated by reference in their entireties.

BACKGROUND OF THE INVENTION

1. Field of the Invention

The invention relates to a conductor connection and, more particularly, to an in-line switch conductor connection.

2. Brief Description of Prior Developments

In the electrical utilities industry, it is sometimes required to disconnect the current from electrical conductors at electrical distribution poles. This disconnect is most often performed at the pole. However it can be accomplished on the line by utilizing a line disconnect device, which may be an in-line switch for example.

An in-line switch generally comprises two mechanical dead ends with an insulator in between them. The mechanical dead ends may also comprise a separate wedge connector. U.S. Pat. No. 5,240,441, which is hereby incorporated by reference in its entirety, discloses one configuration of a separate wedge connector for use in electrical transmission lines. The conductor is mechanically connected to each dead end and than cut in center between the dead ends. The dead ends may have a knife switch blade mounted/fastened to each dead end. This knife switch blade allows the current to flow from one dead end to the other. The knife switch blade may be permanently fastened to one of the dead ends and may be disconnectable from the other. When one end of the blade is disconnected from the dead end, it stops the flow of the current. Conventional configurations require a separate wedge of the wedge connector to be attached to the mechanical dead end between a wedge connector shell and the conductor. A utility worker may have several components of the in-line switch to account for when making these connections. As the number of components and complexity increases for these operations, maintenance down times may increase. This can add up to be a very costly operation for the utility company.

Accordingly, there is a need to provide an in-line switch comprising an improved and robust conductor connection which facilitates installation of the conductors.

SUMMARY OF THE INVENTION

In accordance with one aspect of the invention, an electrical connector frame member is disclosed. The electrical connector frame member includes a first leg section, a conductor receiving section, and a wedge section. The first leg section is configured to be connected to an electrical isolator. The conductor receiving section is connected to the first leg section. The conductor receiving section is configured to receive an electrical conductor. The wedge section extends from the conductor receiving section. The wedge section is integrally formed with the conductor receiving section and comprises a wedge connector shell contact surface. The wedge connector shell contact surface is angled relative to the conductor receiving section.

In accordance with another aspect of the invention, a conductor connector is disclosed. The conductor connector includes a frame and a wedge connector shell. The frame includes a first section having a flange, a second section, and an electrical isolation section between the first section and the second section. The first section is configured to be connected to a first electrical conductor. The second section is configured to be connected to a second electrical conductor. The wedge connector shell includes a boss. The boss includes an opening. The opening is configured to be aligned with a flange hole of the flange.

In accordance with yet another aspect of the invention, a method of manufacturing an electrical connector frame member is disclosed. A conductor receiving section is formed along a first side of the frame member. A wedge connector shell contact section is forming along a second side of the frame member. The wedge connector shell contact section is angled relative to the conductor receiving section. A leg section configured to be connected to an electrical isolator at an end of the frame member is formed.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
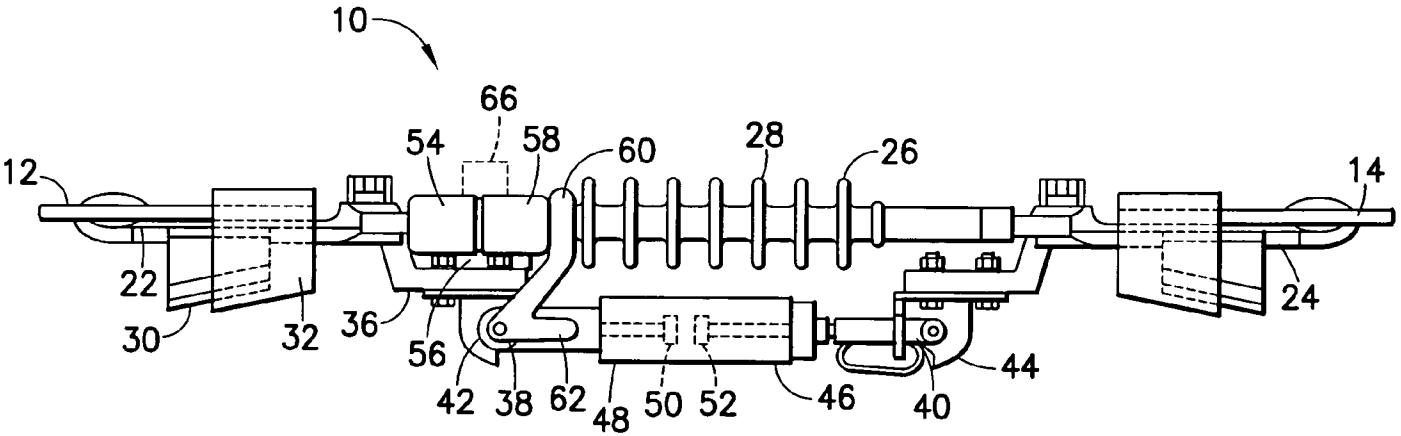
FIG. 1 is an elevational side view of an in-line switch incorporating features of the invention.

Referring to FIG. 1, there is shown an elevational side view of an in-line switch (which may be a vacuum recloser for example) 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The vacuum recloser 10 is shown connecting a first electrical conductor 12 to a second electrical conductor 14. For example, the conductors 12, 14 could be high voltage overhead power distribution lines. However, the vacuum recloser 10 could be used in any suitable application. The vacuum recloser 10 forms a switch between the two conductors 12, 14. When the switch is open, the first and second conductors are not electrically connected to each other through the switch. When the switch is closed, the first and second conductors are electrically connected to each other through the switch. In this embodiment the vacuum recloser is an in-line design connected in-line between the two conductors 12, 14. However, in alternate embodiments, the vacuum recloser could be provided other than in an in-line design.

Figure 2:
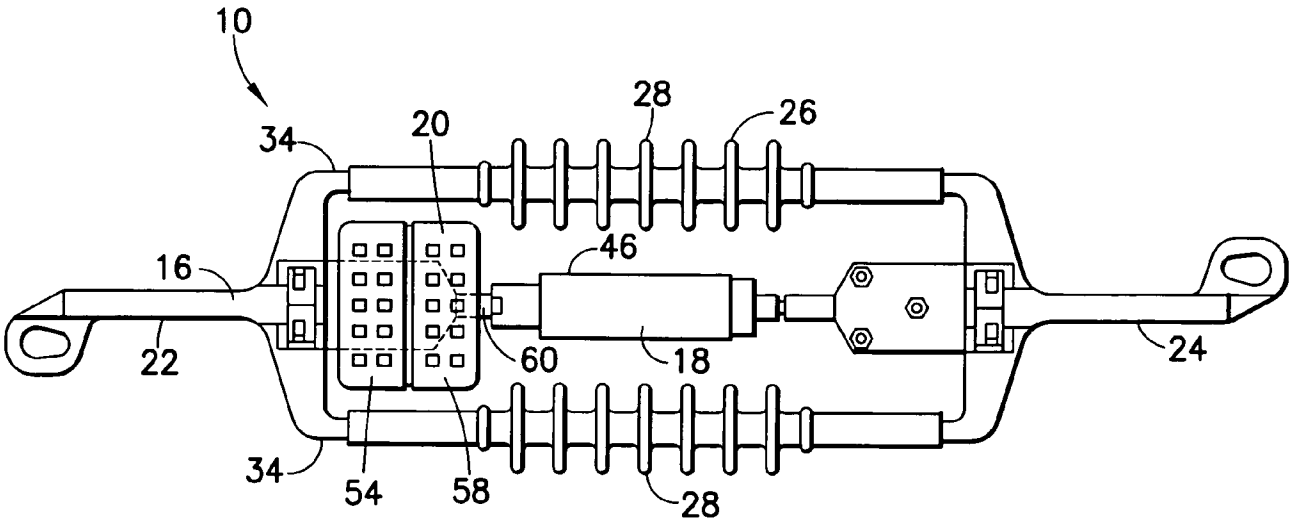
FIG. 2 is a top plan view of the in-line switch shown in FIG. 1.

Referring also to FIG. 2, the vacuum recloser 10 generally comprises a frame 16, an electrical connection section 18, and a control 20. The frame 16 generally comprises a first connection section 22, a second connection section 24, and an electrical isolation section 26. The electrical isolation section 26 structurally connects the first connection section 22 to the second connection section 24. In this embodiment the electrical isolation section 26 comprises two parallel sections 28. Each section 28 has two opposite ends connected to the first and second connection sections, respectively. An open area is formed between the two sections 28. Each section 28 comprises an electrical insulator assembly for electrically insulating the opposite ends of each section 28 from each other and, thus, electrically insulating the first and second sections 22, 24 from each other while still structurally connecting the sections 22, 24 to each other.

In this embodiment, the first and second sections 22, 24 are substantially mirror images of each other. However, in alternate embodiments the two sections 22, 24 could be different. The first connection section 22 is preferably comprised of metal, such as cast metal for example. The first connection section 22 generally comprises an integral wedge section 30 for use with a wedge connector shell 32 for connecting the first connection section 22 with the first conductor. One example of a wedge connector shell is described in U.S. Pat. No. 5,507,671 which is hereby incorporated by reference in its entirety. However, in alternate embodiments, any suitable system for mechanically and electrically connecting the first conductor 12 to the first connection section 22 could be provided. The first connection section 12 comprises two leg sections 34 and a bottom platform section 36. The leg sections 34 are connected to the sections 28 of the electrical isolation section 26. The bottom platform section 36 extends between and beneath the two leg sections. However, in alternate embodiments, the first connection section 22 could comprise any suitable shape. The second connection section 24 is identical to the first connection section; just reversely orientated.

The electrical connection section 18 generally comprises a first end 38 movably connected to the first connection section 22 and an opposite second end 40 movably connected to the second connection section 24. In this embodiment the first end 38 is pivotably connected to the platform section 36 of the first connection section by a pivot connection 42. However, in alternate embodiments, any suitable type of movable connection could be provided. The pivot connection 42 electrically connects the first end 38 to the first connection section 22. The second end 40 is removably connected to the platform section of the second connection section by a latch assembly 44. The latch assembly 44 electrically connects the second end 40 to the second connection section 24. The latch assembly could comprise a primarily friction latch assembly, for example, and could comprise a detent system for preventing unintentional disconnection of the second end 40 from the latch assembly 44.

The electrical connection section 18 forms a movable arm connected between the first and second sections 22, 24. The arm comprises the first and second ends 38, 40 and a vacuum bottle section 46 between the two ends 38, 40. The vacuum bottle section comprises an outer housing 48 and at least two contacts 50, 52 located inside the housing 48. The first contact 50 is adapted to be moved into contact with and out of contact with the second contact 52. The housing 48 could comprise a window to allow a user to view the location of the contacts 50, 52 relative to each other, or the vacuum bottle section 46 could have any other suitable type of visual indicator to signal a user of the open or closed state of the contacts 50, 52. When the contacts 50, 52 are in an open state, the first and second connection sections are not electrically connected to each other. When the contacts 50, 52 are connected to each other in a closed state (with the electrical connection section 18 in the closed configuration shown in FIGS. 1 and 2; contacting the latch assembly 44), the first and second sections 22, 24 are electrically connected to each other.

The control 20 generally comprises three sections; an inductively coupled power supply section 54, a recloser electronic control section 56, and a capacitive discharge and solenoid actuation section 58. These three sections could be mounted on a single printed circuit board as separate modules for example. The inductively coupled power supply section 54 generally comprises a current transformer. Electricity can be inductively generated by the power supply section which is stored by the capacitors and powers the control section 56. The recloser electronic control section 56 generally comprises a voltage monitoring section. The control section 56 can continuously monitor the voltage from the current transformer and, thus, monitor the current being transmitted through the vacuum closer 10 between the two conductors 12, 14. A memory is provided on the printed circuit board which contains pre-installed action criteria. The recloser electronic control section 56 can use this pre-installed action criteria and sensed real time conditions to determine if the contacts 50, 52 of the vacuum bottle section 46 should be opened to stop transmission of current through the vacuum recloser 10.

The capacitive discharge and solenoid actuation section 58 generally comprises capacitors and a solenoid 60. Electricity from the transformer can be stored in the capacitors for use in actuating the solenoid 60 when directed by the recloser electronic control section 56. The solenoid 60 is connected to the first contact 50 of the vacuum bottle section 46 by an armature mechanism 62. When the solenoid relay piston of the solenoid is moved outward, the armature mechanism 62 is adapted to move the first contact 50 out of contact with the second contact 52. Similarly, when the solenoid relay piston of the solenoid is moved inward, the armature mechanism 62 is adapted to move the first contact 50 into contact with the second contact 52. In one type of embodiment the solenoid is a bi-polar solenoid. However, any suitable solenoid could be used. Alternatively, any suitable type of armature drive system could be used.

Figure 3:
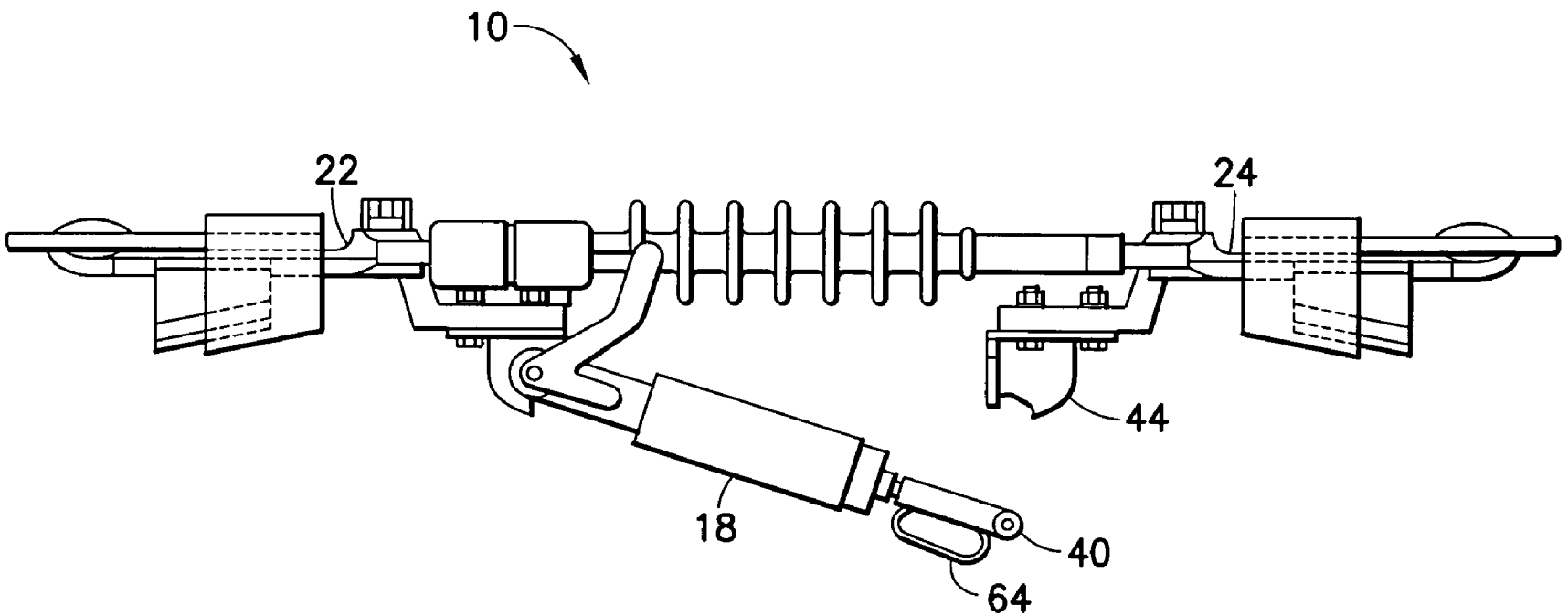
FIG. 3 is an elevational side view of the in-line switch shown in FIG. 1 with an arm of its electrical connection section moved to an open condition.

The control 20, in combination with the armature mechanism 62 and the vacuum bottle section 46 form a first system for opening and closing a path between the first and second connection sections 22, 24. This first system can function automatically based upon real time conditions, such as opening the switch when a voltage overload is occurring. In addition to this first system, the vacuum recloser 10 comprises a second system for opening and closing the path between the first and second connection sections 22, 24. The second system allows a user to manually open and close the path by manually connecting and disconnecting the second end 40 of the vacuum bottle section with the second connection section 24. Referring also to FIG. 3, a further description will be provided.

FIG. 3 shows the vacuum recloser 10 in a manually open state. FIGS. 1 and 3 show the vacuum recloser in a manually closed state. In the manually closed state, the contacts 50, 52 of the vacuum bottle section determine if the switch is opened or closed. In the manually open state, the switch is open regardless of the position of the contacts 50, 52 relative to each other. In the manually open state, the user has moved the second end 40 of the electrical connection section 18 away from connection with the latch assembly 44. This breaks the circuit path through the electrical connection section 18. The second end 40 has a handle 64 for the user to grasp or attach a hot stick to, in order to move the electrical connection section 18 to its open position. When the user is completed performing tasks downstream from the vacuum recloser, the user can then merely return the electrical connection section 18 back to its closed position shown in FIGS. 1 and 2. Cycling of the electrical connection section 18 between its manually open and manually closed positions could also be used to reset the solenoid 60 and armature mechanism back to a home state.

The invention relates to the development of components and devices to modify and improve the application of an in-line switch and will enable it to act as a vacuum recloser. The application of this switch in this fashion eliminates several costly processes and component parts to dramatically reduce production costs while offering similar performance with several additional labor saving and safety related enhancements. Key features include reduced cost, and an ability to unlock a vacuum bottle switch component and swing it down to visually and electrically isolate the downstream circuit for safety reasons. This provided an elimination of a "one shot to lockout" design requirement. The invention is modular so as to allow offering a 1 phase version and a 3 phase version. The present invention reduces the number of additional products typically required and associated with a typical vacuum recloser installation.

The invention could be offered as a switching device product that requires installation with a WEJTAP system, such as with the shells 32. The WEJTAP system is offered by FCI USA, Inc. under the BURNDY line of products. However, in alternate embodiments, any suitable type of connection system for connecting the assembly 10 with the electrical conductors 12, 14 could be provided. The invention could be incorporated into a distribution class (15-35 KVolt) switching device that is installed directly onto an aluminum bare conductor. The switching device can serve as a vacuum recloser, similar to conventional vacuum recliners now commonly used and understood in their traditional, but the invention can comprise a novel feature that it is spliced directly in-line and mid span on the bare overhead conductor and not mounted on any supporting structure as they are now traditionally done. By suspending the switching device mid span, many expensive insulating and heavy mounting components are eliminated reduce its installation cost by 30% or more.

The invention can comprise an in-line switch frame, a vacuum bottle connected between energized sections of the in-line switch frame to serve as the switching medium, a driver circuit consisting of at least one solenoid relay for opening and closing the vacuum bottle mechanism, a voltage/current sensing and control circuit to continuous monitor electrical readings and provide intelligence for energy interruption during predetermined conditions that otherwise could be detrimental to the electrical system and other connected electrical components. The system could also comprise a one-way or a two-way communication circuit 66 (see FIG. 1) to allow communication between multiple components in close proximity, or communication to and/or from a remote central monitoring station. Any suitable communication circuit could be provided, such as a wireless cellular or satellite communications device for example. For example, if the communication circuit 66 allows communication with a remote central monitoring station, the communication circuit 66 could inform the monitoring station when the switch is automatically opened. Additionally, or alternatively, the communication circuit 66 could be used by the monitoring station to remotely trigger changing of the switch in the vacuum bottle section from an open state to a closed state. This might be particularly advantageous for reaching lines which otherwise would be accessed by helicopter. A stored energy circuit could be provided that utilizes Ferro resistant technology to store capacitive energy to power the vacuum bottle switching, the voltage/current sense and control circuit, and the communication circuitry.

The set of contacts 50/52 can open and close to energize and de-energize the circuit while the switch remains in the visual representation shown in FIGS. 1 and 2. With a conventional vacuum recloser, the contacts inside the vacuum bottle cannot be seen visually and there is way by which a person can visually verify a vacuum bottle open or closed contact state; except to trust an indicator mechanism on the solenoid armature mechanism that the contacts are open or closed. The invention, on the other hand as shown by FIG. 3, allows a user to physically disconnect the vacuum bottle from one of the high-voltage transmission lines. Historically, a user has always been very nervous about trusting his or her life to the little armature mechanisms that say the contacts (which are inside the little bottle and cannot seen) are open or closed.

After installation, when the line is energized, the power supply module takes power inductively from the energized circuit and allocates it to the recloser control module and the capacitive module section. The recloser electronic control supplies the intelligence to make open/close decisions. Signals from the current transformer and the voltage monitoring section of the power supply module are fed into the electronic control and are continuously monitored. Its decision to act is based on a comparison of what it is seeing (real-time) on the line with what is stored into its pre-installed memory as action criteria. If a line fault or disturbance occurs, it will be fed real-time to the closure control module. If the sensed real-time conditions meet the criteria required for an opened or closed action, it will instruct one or more of the power capacitors to discharge. The discharging capacitors have the required power to cause the solenoid to open or close causing the solenoid relay piston to move forward or backward. The piston is connected through a mechanism that is, in turn, connected to the vacuum bottle armature. The completed action results in the vacuum bottle contacts being opened or closed rapidly.

Figure 4:
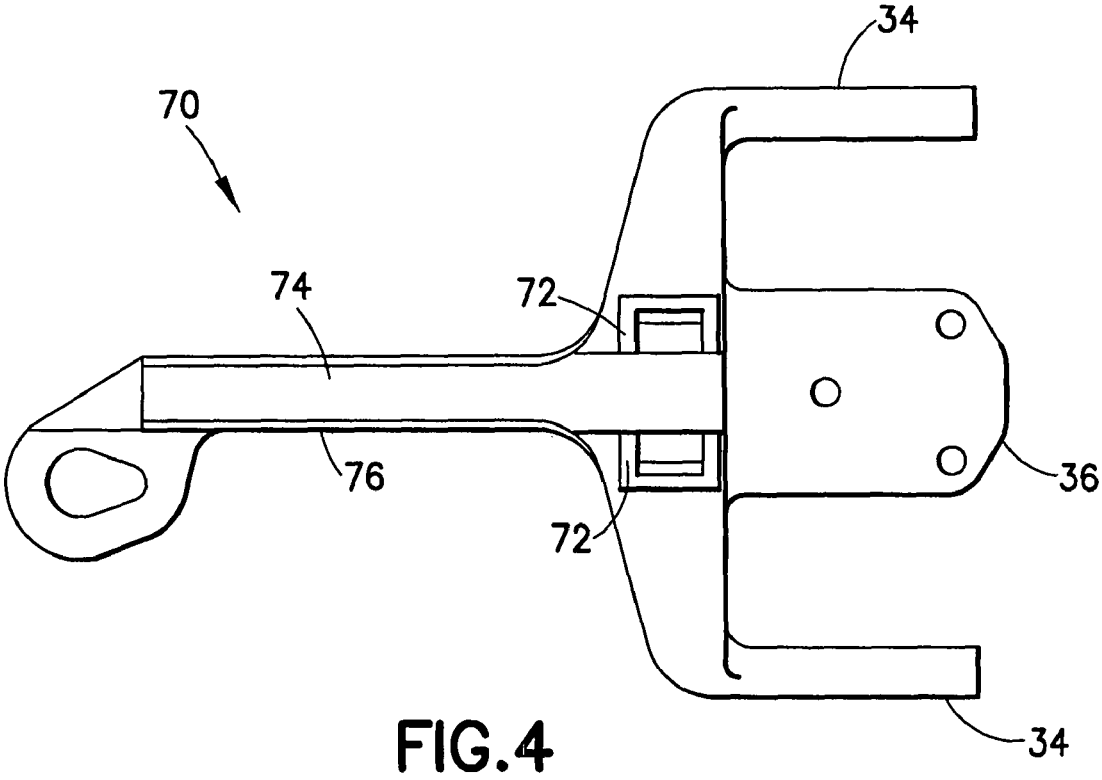
FIG. 4 is a top plan view of a first connection section of the in-line switch shown in FIG. 1.
Figure 5:
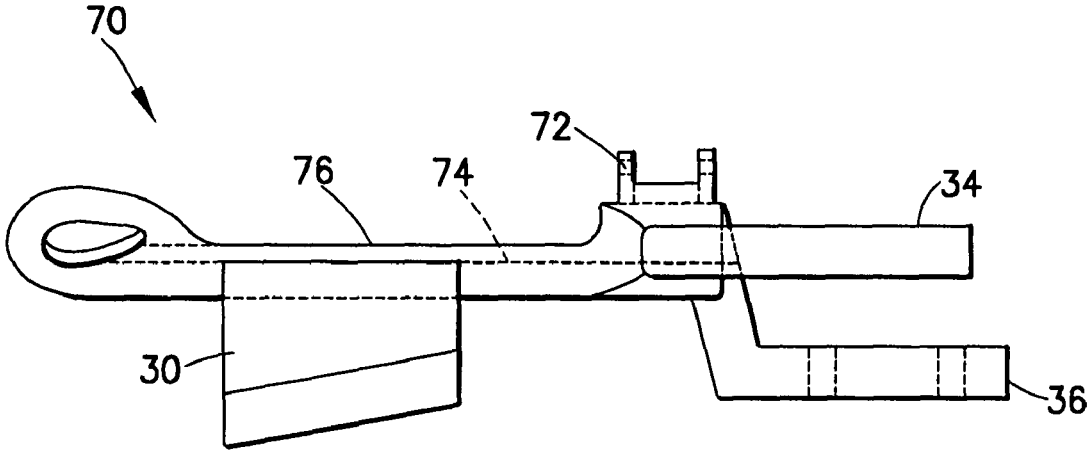
FIG. 5 is a side view of the first connection section of the in-line switch shown in FIG. 1.
Figure 6:
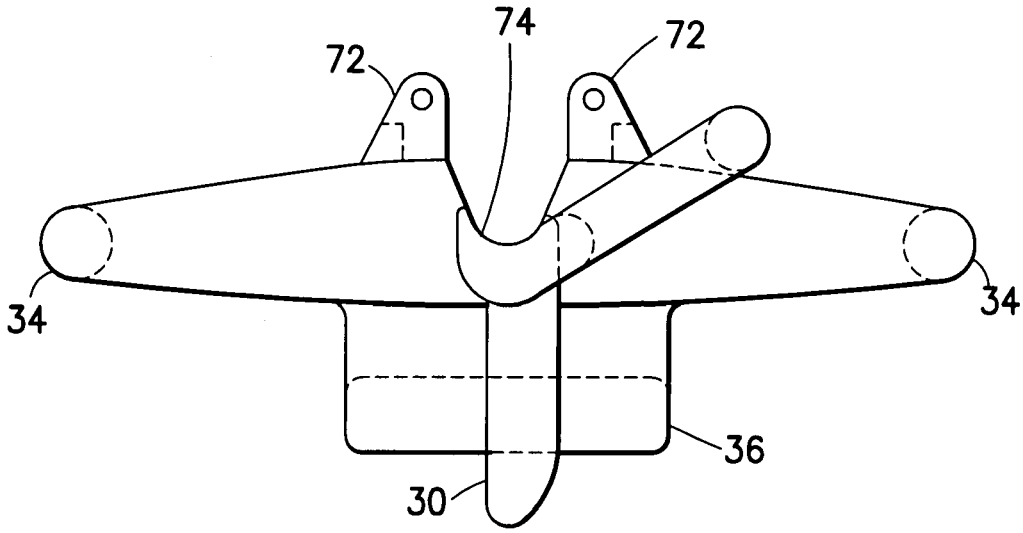
FIG. 6 is a front view of the first connection section of the in-line switch shown in FIG. 1.
Figure 7:
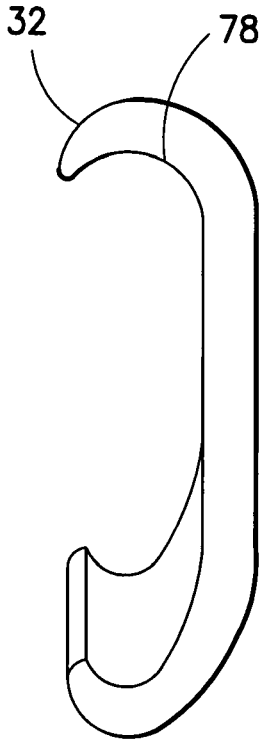
FIG. 7 is a front view of a wedge connector shell of the in-line switch shown in FIG. 1.
Figure 8:
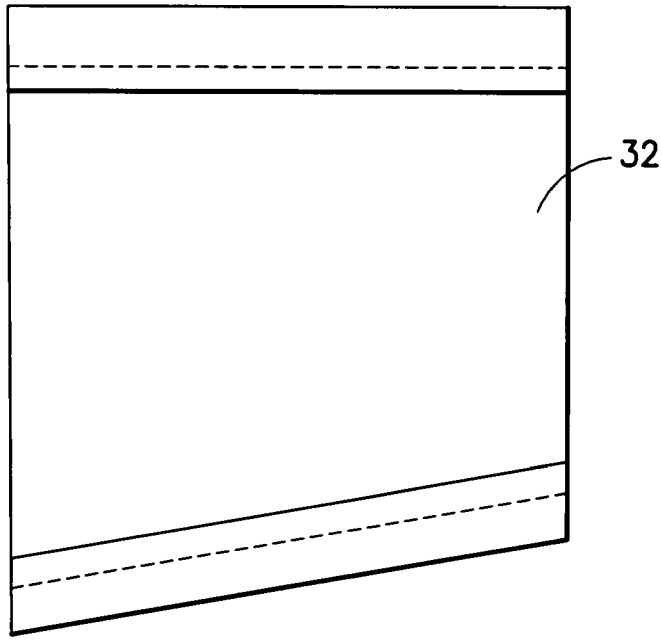
FIG. 8 is a side view of the wedge connector shell of the in-line switch shown in FIG. 1.
Figure 9:
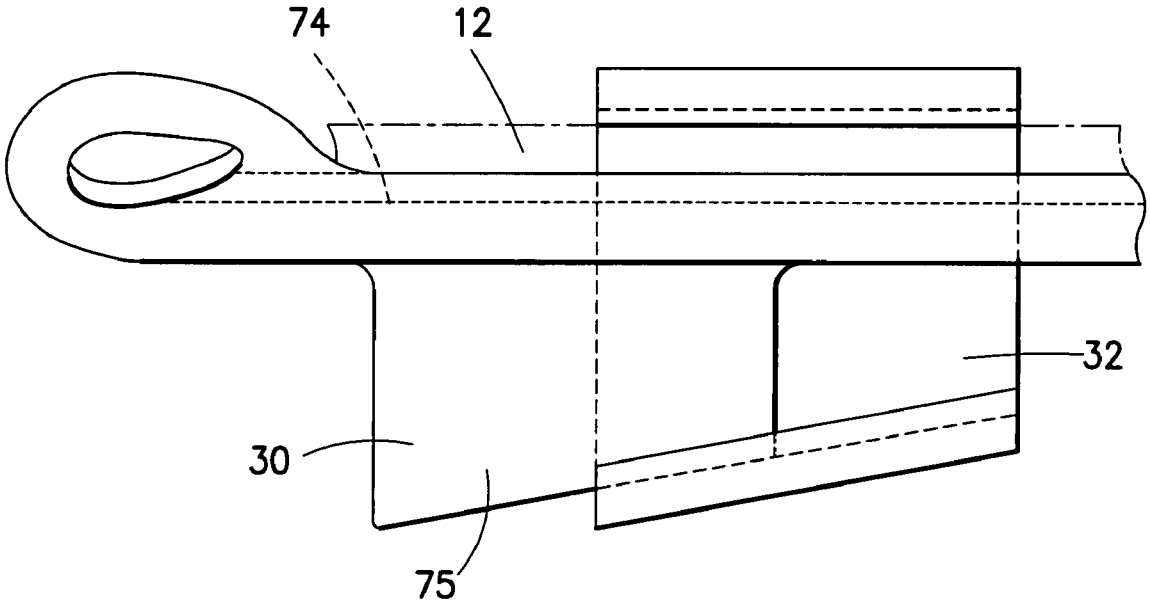
FIG. 9 is an enlarged view of a portion of the first connection section of the in-line switch shown in FIG. 1.
Figure 10:
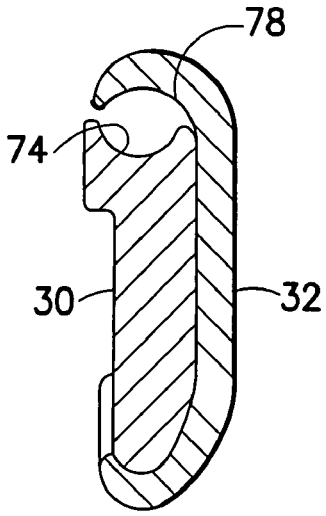
FIG. 10 is a cross section view of the first connection section of the in-line switch shown in FIG. 1 taken at the wedge connector shell.

Referring also to FIGS. 4-6, there is shown a first connection section 22 in accordance with a first embodiment of the present invention. The first connection section 22 preferably comprises a one-piece frame member 70 forming the leg sections 34 and the bottom platform section 36. At a junction of the leg sections 34 and the bottom platform section 36 the frame member 70 comprises two pivot mounting areas 72. A conductor receiving seat, or conductor receiving section, 74 is located between the areas 72 and extends along the length of the mounting section 76. The integral wedge section 30 extends from the bottom side of the mounting section 76. The seat 74 is sized and shaped to receive the conductor 12 therein. FIGS. 7-8 show one example of the conductor shell 32. As seen in FIGS. 9-10, the conductor shell 32 can be mounted onto the integral wedge section 30 to wedge the conductor 12 between the surface 78 of the shell 32 and the seat 74.

In the electrical utilities industry it is sometimes required to disconnect the current. This disconnect is most often done at the pole. However it can be accomplish on the line. In order to make a line disconnect, a device called an in-line switch, is used. The in-line switch consists of two mechanical dead ends with an insulator in between them.

The conductor is mechanically connected to each dead end and than cut in the center between the dead ends. The dead ends have a knife switch blade mounted that is fasten to each dead end. This knife switch blade allows the current to flow from one dead end to the other. The knife switch blade is permanently fasten to one of the dead ends and is disconnectable from the other. When the one end of the blade is disconnected from the dead end it stops the flow of the current.

The mechanical gripping device of the dead end consists of two components. The dead end body 70 that has a permanent cast-in wedge 30 and a 'C' shape wedging body or shell 32. It should be noted that the integral wedge 30 may be attached to the dead end body 70 by any other suitable operation, such as welding for example. The dead end body has a concave groove 74 that extends the length of the body. The concave groove is designed to accept the recommended size conductor. The opposite side of the concave groove has a wedge shape configuration 30. The angle of the wedge is design so that the widest side is toward the out direction of the body (or tapers away from an end of the body 70). The bottom (or the wedge connector shell contact surface 75) of the wedge has a convex radius (or convex profile) that extends the length of the wedge. The wedge connector shell contact surface 75 is angled relative to the conductor receiving section or groove 74. The 'C' shape body (or shell member) 32 has an angle that also extends the length of it. The 'C' shape body 32 consists of two concave radiuses 178 that are 180 degrees apart. These two radiuses are connected on one side only. One of the concave radius makes contact with the conductor and the other makes contact with the convex radius on the wedge.

With the conductor in the concave groove 74 of the body 70, the 'C' shape body 32 is positioned onto the conductor 12. One side of the concave radius makes contact with the conductor 12 and the opposite concave radius contacts the wedge portion of the body. As the 'C' shape moves forward toward the direction of the pull, the pressure on the conductor is increased.

Figure 11:
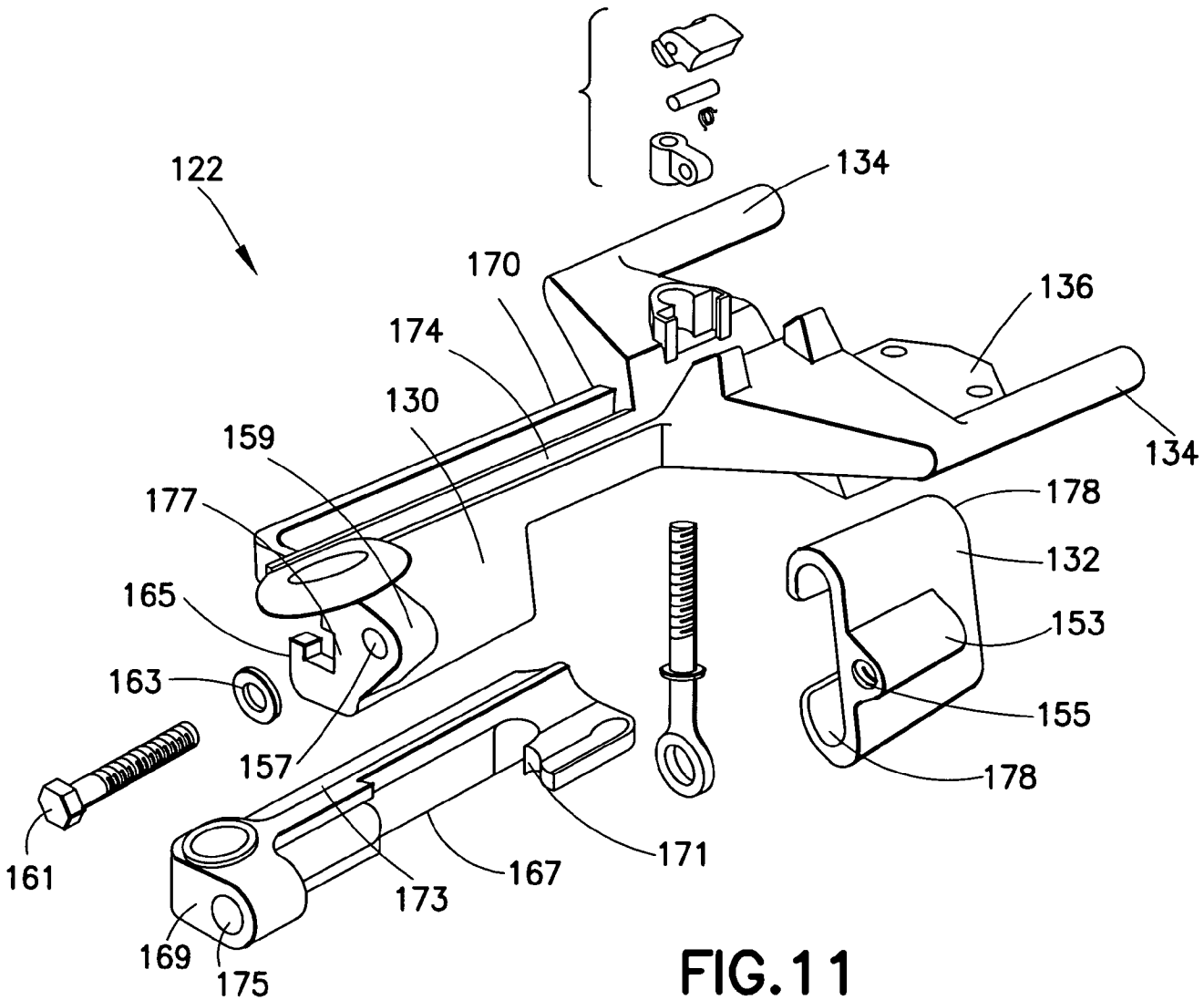
FIG. 11 is an exploded perspective view of a first connection section in accordance with a second embodiment of the invention.

Referring now to FIG. 11, there is shown an exploded perspective view of a first connection section 122 comprising a one-piece frame member 170 in accordance with a second embodiment of the present invention. The first connection section 122 and the one-piece frame member 170 are similar to the first connection section 22 and the one-piece frame member 70 of the first embodiment and similar features are similarly numbered.

Figure 12:
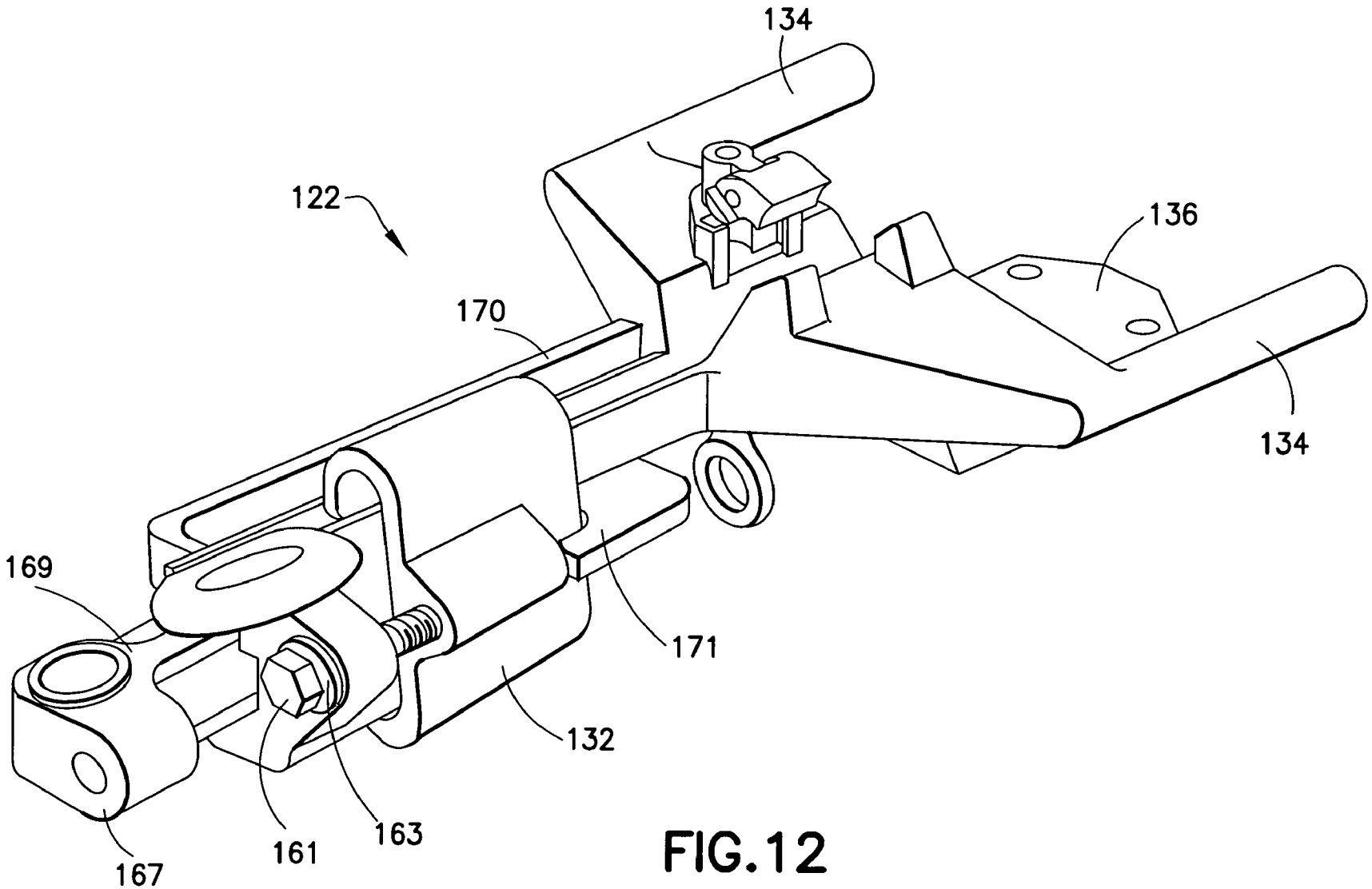
FIG. 12 is perspective view of the first connection section shown in FIG. 11.
Figure 13:
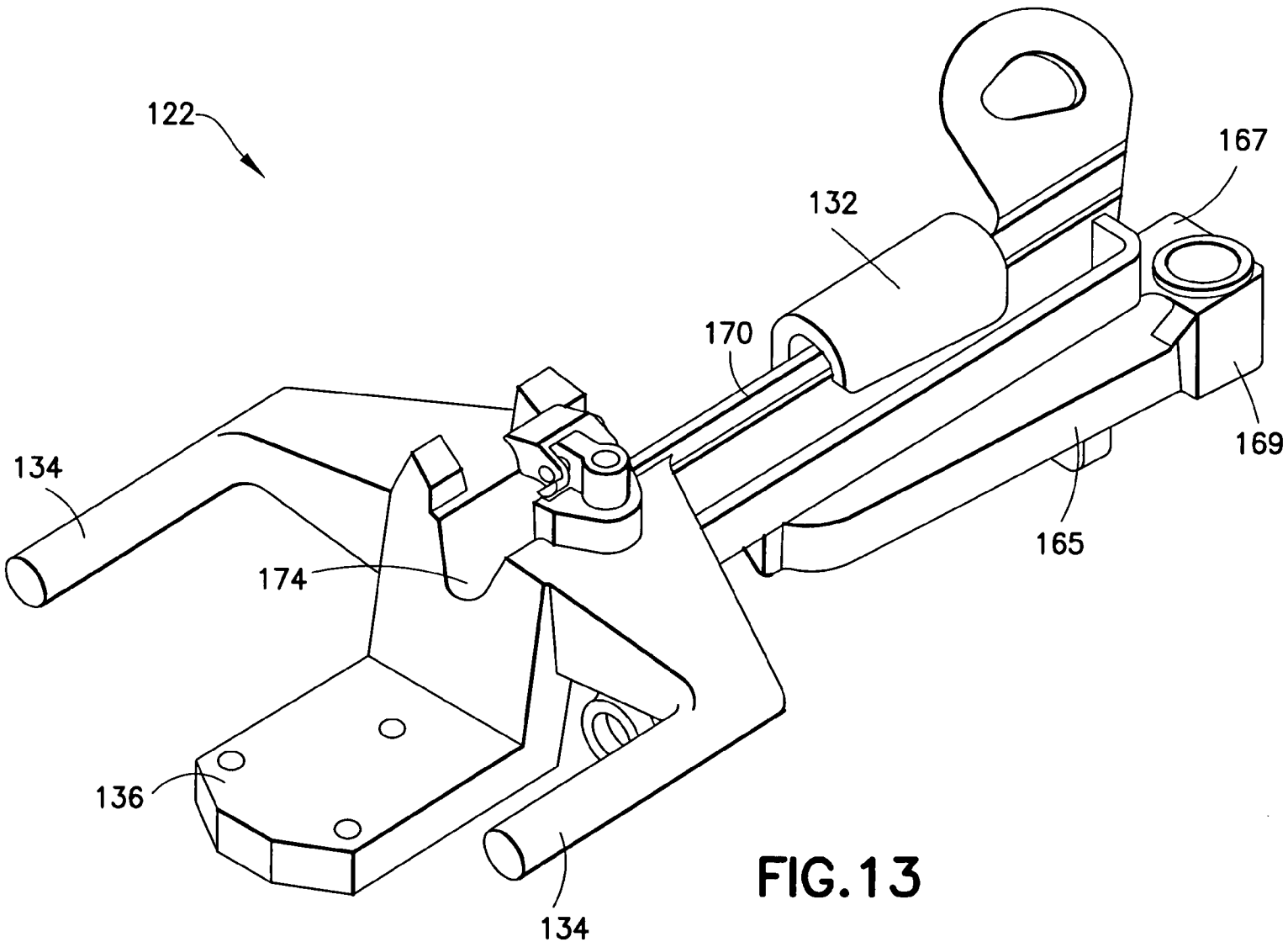
FIG. 13 is perspective view of the first connection section shown in FIG. 11.

Referring also to FIGS. 12 and 13, the one-piece frame member 170 comprises leg sections 134, a bottom platform section 136, a conductor receiving seat or groove 174, and an integral wedge 130 as described above for the first embodiment.

Figure 14:
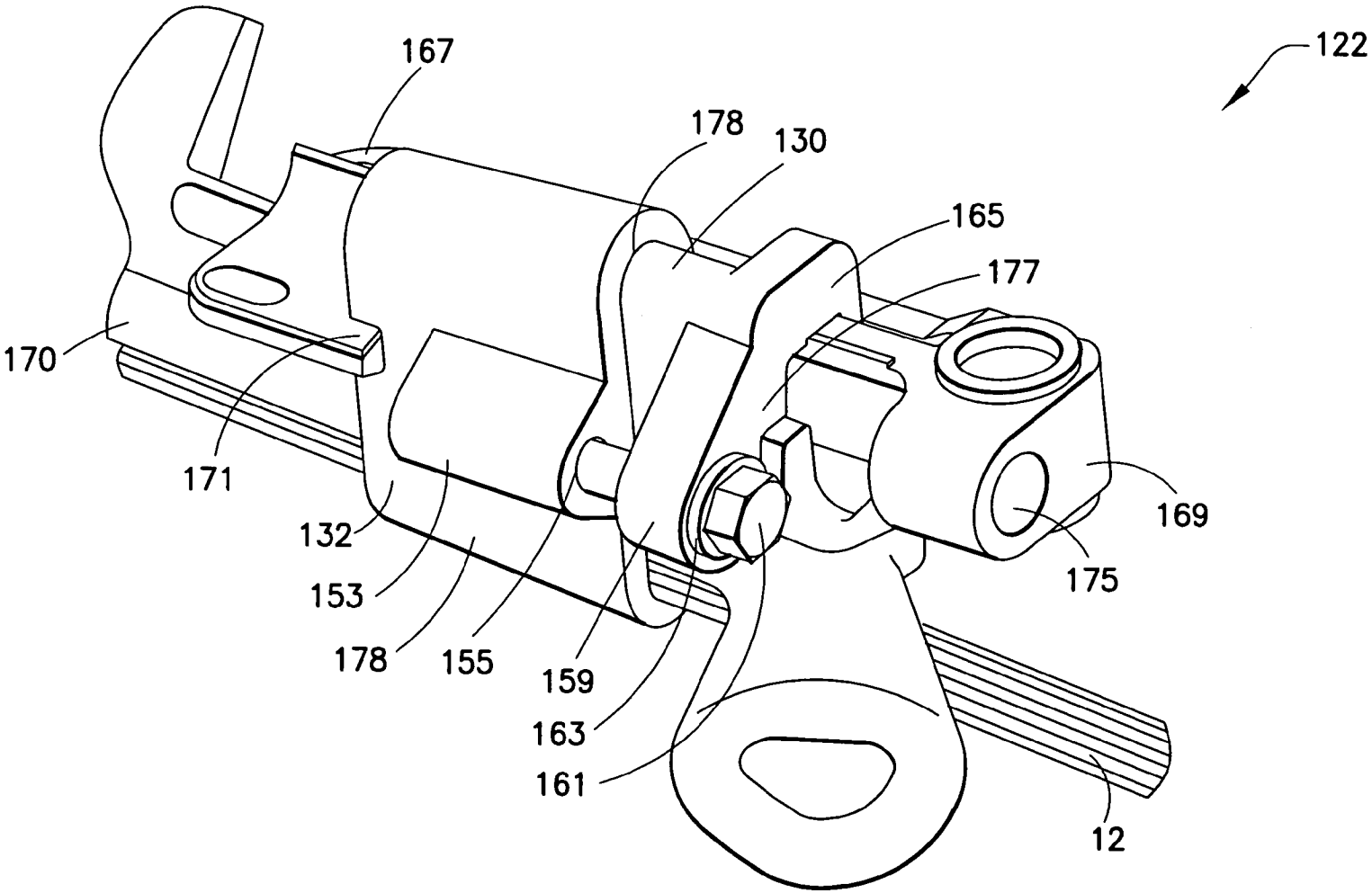
FIG. 14 is a partial perspective view of the first connection section shown in FIG. 11.

One difference between the first connection section 122 and the first connection section 22 is that an alternate embodiment of a "C" body 132 (best illustrated in FIG. 14) may be provided when it is desired that the unit be bolted. The "C" body 132 may have a boss 153 on the back side (opposite the "C" shape) comprising a threaded hole 155. When the "C" body 132 is installed on to the stationary wedge 130, with the conductor 12 in it, the threaded boss 153 is then aligned with a hole 157 (best seen in FIG. 16) in a flange 159 at the large end of the wedge. A bolt (or fastener) 161 is installed thru the non-threaded hole 157 in the flange 159 and then threaded into the threaded boss 153. Additionally, a washer 163 may also be installed between the bolt 161 and the flange 159. As the bolt 161 is tightened down, it pulls the "C" body 132 into a locking wedge position. One example of a wedge connector is described in U.S. Pat. No. 5,340,335.

An "L" shape protrusion or tool holder 165 (best illustrated in FIG. 16) may also be provided at the large end of the wedge 130. This protrusion 165 is designed to contain the head 167 of the fire on tool 169 during the installation. The fire on tool 169 comprises locking flanges 171, a protruding flange 173, and a power ram cavity 175. When the fire on tool 169 is received by the tool holder 165, ends of the fire on tool 169 extend toward the "C" member 132 and the end of the one-piece frame member 170. The locking flanges 171, which are proximate one end of the fire on tool 169, are configured to engage with a narrow end of the "C" body 132. And the power ram cavity 175, proximate the other end of the fire on tool 169, is aligned with a power ram guide 177 of the one-piece frame member 170. These tool features facilitate the use of a power tool during installation of the conductor 12 between the "C" member 132 and the wedge 130.

The disclosed integral wedge provides an improved configuration over conventional electrical distribution connectors. The disclosed integral wedge provides for a robust configuration which facilitates installation and connection of the conductors. Additionally, the disclosed configuration assures the correct size wedge is provided at the connector (as opposed to separate wedge configurations) as the wedge is integral with the in-line switch. This provides for increased efficiency and reduced maintenance times by the utility worker performing the operation.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector frame member of an electrical connector frame comprising:

a first leg section sized and shaped to be connected to an electrical isolation section of the electrical connector frame;

a conductor receiving section connected to the first leg section, wherein the conductor receiving section is configured to receive an electrical conductor; and a wedge section extending from the conductor receiving section, wherein the wedge section is integrally formed with the conductor receiving section and comprises a wedge connector shell contact surface, wherein the wedge connector shell contact surface is angled relative to the conductor receiving section, and wherein the frame member is configured for removably mounting a wedge connector shell over the conductor receiving section and the wedge section, wherein the electrical connector frame member comprises a one-piece member forming at least the conductor receiving section and the wedge section.

2. The electrical connector frame member of claim 1 wherein the wedge connector shell contact surface tapers away from an end of the frame member.

3. The electrical connector frame member of claim 1 wherein a flange section comprising an opening extends from a first end of the wedge section.

4. The electrical connector frame member of claim 1 wherein a generally "L" shaped protrusion section extends from a first end of the wedge section.

5. The electrical connector frame member of claim 1 wherein the wedge connector shell contact surface comprises a general convex profile.

6. The electrical connector frame member of claim 1 wherein the frame member is configured to have a generally "C"-shaped shell member installed over the wedge section and the conductor receiving section.

7. The electrical connector frame member of claim 1 wherein the wedge section is integrally cast with the conductor receiving section.

8. The electrical connector frame member of claim 1 wherein the wedge section is configured to provide an interference fit between the electrical conductor and a generally "C"-shaped shell member.

9. The electrical connector frame member of claim 1 where the wedge section extends from a bottom side of the frame member, and wherein the conductor receiving section extends along a top side of the frame member.

10. A conductor connector comprising:

an electrical connector frame member as in claim 1;

a generally "C"shaped shell member connected to the electrical connector frame member; and an electrical isolation section connected to the electrical connector frame member.

11. The electrical connector frame member of claim 1 wherein the wedge connector shell contact surface tapers away from a first end of the frame member, and wherein a flange section comprising an opening extends from the first end of the wedge section.

12. The electrical connector frame member of claim 11 wherein a generally "L" shaped protrusion section extends from the first end of the wedge section.

13. The electrical connector frame member of claim 12 wherein the flange section is opposite the generally "L" shaped protrusion section.

14. A conductor connector comprising:

a frame comprising a first section having a flange, a second section, and an electrical isolation section between the first section and the second section, wherein the first section is configured to be connected to a first electrical conductor, wherein the second section is configured to be connected to a second electrical conductor, and wherein the electrical isolation section is configured to electrically insulate the first and second sections from each other; and a wedge connector shell comprising a boss, wherein the boss comprises an opening, and wherein the opening is configured to be aligned with a flange hole of the flange.

15. The conductor connector of claim 14 wherein the first section further comprises a wedge section integrally formed with the first section.

16. The conductor connector of claim 15 wherein the wedge connector shell is installed over the wedge section.

17. The conductor connector of claim 15 wherein the wedge connector shell is configured to, secure the first electrical conductor between the wedge section and the wedge connector shell.

18. The conductor connector of claim 15 wherein the wedge section extends from a conductor receiving section of the first section.

19. The conductor connector of claim 15 wherein the wedge section comprises a wedge connector shell contact surface, wherein the wedge connector shell contact surface is angled relative to the first section.

20. The conductor connector of claim 14 further comprising a fastener, wherein the fastener extends through the flange hole of the flange, and wherein the fastener is engaged with the opening.

21. The conductor connector of claim 14 further comprising a generally "L" shaped protrusion extending from the first section, wherein the generally "L" shaped protrusion is configured to hold a tool adjacent to the first section.

22. The conductor connector of claim 21 wherein the generally "L" shaped protrusion is opposite the flange.

23. The conductor connector of claim 14 wherein the first section comprises a generally concave groove along top side of the first section and a generally convex profile extending along bottom side of the first section.

24. The conductor connector of claim 14 wherein the wedge connector shell is slidably connected to the first section.

25. The conductor connector of claim 14 further comprising a pivoting arm connected between the first section and the second section, wherein the pivoting arm is configured to electrically connect the first section to the second section.

26. A method of manufacturing an electrical connector frame member comprising:

forming a conductor receiving section, wherein the conductor receiving section extends in a first direction and along a first side of the frame member;

forming a wedge connector shell contact section along a second side of the frame member, wherein the wedge connector shell contact section is angled relative to the conductor receiving section, wherein the frame member is configured to allow a wedge connector shell to move along the first side and the wedge connector shell contact section from a first position to a second position, wherein the wedge connector shell contact section is configured to remain stationary relative to the conductor receiving section when the wedge connector shell is moved from the first position to the second position, and wherein in the first position the wedge connector shell is substantially offset in the first direction from the wedge connector shell contact section; and forming a leg section configured to be connected to an electrical isolator, wherein the leg section extends from an end of the frame member in substantially the first direction.

27. A vacuum recloser comprising:

a conductor connector comprising a frame and a wedge connector shell, wherein the frame comprises a first section having a flange, a second section, and an electrical isolation section between the first section and the second section, wherein the first section is configured to be connected to a first electrical conductor, wherein the second section is configured to be connected to a second electrical conductor, wherein the wedge connector shell comprises a boss, wherein the boss comprises an opening, and wherein the opening is configured to be aligned with a flange hole of the flange; and a vacuum bottle section connected between the first section and the second section.

28. An electrical connector frame member comprising:

a first leg section sized and shaped to be connected to an electrical isolator;

a conductor receiving section connected to the first leg section; and a wedge section extending from the conductor receiving section, wherein the wedge section is integrally formed with the conductor receiving section and comprises a wedge connector shell contact surface, wherein the wedge connector shell contact surface is angled relative to the conductor receiving section, wherein the frame member is configured to have a generally "C"-shaped shell member installed over the frame member with only a single conductor therebetween, wherein the wedge section is configured to be fixedly attached to the frame member when the "C"-shaped shell member is not installed over the frame member, and wherein the conductor receiving section is configured to receive the single conductor.

* * * * *